US009382726B2

(12) United States Patent
Nordlinger

(10) Patent No.: US 9,382,726 B2
(45) Date of Patent: Jul. 5, 2016

(54) FENCE APPARATUS

(71) Applicant: Joseph Nordlinger, Napa, CA (US)

(72) Inventor: Joseph Nordlinger, Napa, CA (US)

( * ) Notice: Subject to any disclaimer, the term of this patent is extended or adjusted under 35 U.S.C. 154(b) by 2 days.

(21) Appl. No.: 14/833,124

(22) Filed: Aug. 23, 2015

(65) Prior Publication Data

US 2015/0361688 A1 Dec. 17, 2015

Related U.S. Application Data

(63) Continuation-in-part of application No. 13/868,925, filed on Apr. 23, 2013, now abandoned.

(51) Int. Cl.

| | |
|---|---|
| ***E04H 17/06*** | (2006.01) |
| ***E04H 17/16*** | (2006.01) |
| ***E04H 17/04*** | (2006.01) |
| ***E04H 17/08*** | (2006.01) |
| ***B21F 27/00*** | (2006.01) |
| ***E04H 17/14*** | (2006.01) |

(52) U.S. Cl.

CPC ..... *E04H 17/16* (2013.01); *B21F 27/00* (2013.01); *E04H 17/04* (2013.01); *E04H 17/06* (2013.01); *E04H 17/08* (2013.01); *E04H 17/1408* (2013.01)

(58) Field of Classification Search

CPC ..... E04H 17/00; E04H 17/14; E04H 17/1408; E04H 17/1417

USPC ..... 52/745.09; 256/1, 19, 20, 24, 45

See application file for complete search history.

(56) References Cited

U.S. PATENT DOCUMENTS

| | | | | |
|---|---|---|---|---|
| 3,050,287 | A * | 8/1962 | Bloch | E04H 17/1408 256/19 |
| 3,799,506 | A * | 3/1974 | Schwartz | E04H 17/1408 256/24 |
| 4,860,997 | A * | 8/1989 | Schoenheit | E04H 17/066 245/11 |
| 6,802,496 | B1 * | 10/2004 | Preta | E04H 17/1413 16/253 |
| D608,474 | S | 1/2010 | Metcalf et al. | |

FOREIGN PATENT DOCUMENTS

| | | | |
|---|---|---|---|
| AU | 2010101138 | A4 | 10/2010 |
| CN | 201110021 | Y | 9/2008 |
| CN | 201915686 | U | 8/2011 |
| DE | 4320882 | A1 | 1/1995 |
| JP | 10238174 | A | 9/1998 |
| JP | 2004225382 | A | 8/2001 |
| JP | 2002285738 | A | 10/2002 |
| JP | 3145547 | A4 | 10/2008 |
| JP | 3156155 | A | 12/2009 |
| JP | 3161208 | U | 7/2010 |
| KR | 2010132722 | A | 12/2010 |

* cited by examiner

*Primary Examiner* — Brian Glessner
*Assistant Examiner* — Adam Barlow
(74) *Attorney, Agent, or Firm* — Roland J. Tong

(57) ABSTRACT

A barrier material that includes a plurality of frame members adapted to form a frame, a plurality of support rods positioned in between the frame members, a barrier positioned within the frame, and a replacement barrier mat adapted to replace the barrier. The replacement barrier mat includes a plurality of intertwined material adapted to provide a wall and a plurality of tubes surrounded by the intertwined material. The tubes are adapted to receive the support rods inserted into the tubes. When the support rods are inserted into their respective tubes, the replacement barrier mat is positioned within the frame and forms a framed well.

2 Claims, 11 Drawing Sheets

FENCE APPARATUS

CROSS-REFERENCE TO RELATED APPLICATIONS

This application is a continuation-in-part of patent application Ser. No. 13/868,925 filed Apr. 23, 2013, the disclosure of which is incorporated in its entirety by reference,

TECHNICAL FIELD

The present disclosure relates to fences, in particular fences adapted to form functional or decorative barriers that may include longitudinal rails and upright members; fences that may be made of panels; and fences that may include strands of woven materials.

BACKGROUND

Fences contribute to the overall appeal of a property. Various types of fences are presently in use, including concrete, picket fences made of wood or vinyl materials, bricks, wires, and the like. Fences made of natural or indigenous materials are also presently in use, such as fences made of bamboos. These fences that are made of natural or indigenous materials may be appealing, as they may bring about a message of being environmentally conscious, earthy, or green. Because the natural or indigenous materials may not be as durable as metal or concrete fences, it is desirable to have fence apparatus and methods that utilize natural or indigenous materials in a manner where their ability to withstand the test of time and damaging elements or weather is improved.

SUMMARY

The present disclosure relates a barrier material that includes at plurality of frame members adapted to form a frame; a plurality of support rods positioned in between the frame members; a plurality of vineyard canes intertwined around the plurality of support rods; and at least one rail positioned in between the frame members, the rail being adapted to support the frame members.

The present disclosure also relates to a barrier apparatus that includes a plurality of frames, each of the plurality of frames comprising: a plurality of frame members; a plurality of support rods positioned in between the plurality of frame members; and a plurality of vineyard canes twisted around each of the plurality of support rods, the plurality of vineyard canes adapted to form a wall; at least One support pole corresponding to each of the plurality of frames; and an in-ground pole mount comprising a recess formed from a ground and a sleeve positioned within recess, the sleeve being configured to contain a portion of the support pole.

The present disclosure further relates to a method of creating a barrier, the method comprising: processing a plurality of vineyard canes; providing a plurality of frame members; forming a frame using the plurality of frame members; providing a plurality of support rods and positioning each of the plurality of support rods within frame; and weaving the plurality of vineyard canes around the plurality of support rods, wherein the plurality of vineyard canes form a wall that serves as a barrier.

In certain embodiments, a replacement barrier mat is provided to replace the barrier. The replacement barrier mat includes a plurality of intertwined material adapted to provide a wall and a plurality of tubes surrounded by the intertwined material. The tubes receive the support rods that are inserted into them, When the support rods are inserted into their respective tubes, the replacement barrier mat is positioned within the frame and forms a framed wall. The plurality of intertwined material of the replacement barrier mat may be in a form of intertwined vineyard canes. The tubes may be made of PVC pipes. They may be positioned parallel to each other and may be removable from the intertwined material.

The present disclosure relates to a method of replacing a wall of a fence having a plurality of frame members adapted to form a frame and a plurality of support rods positioned in between the frame members. The method includes the step of providing a barrier replacement mat, which includes a plurality of intertwined material adapted to provide a wall. The method further includes the step of inserting support rods into the plurality of intertwined material to position the plurality of intertwined material within the frame. The intertwined material may be in the form of intertwined plant material, such as vineyard canes. In certain embodiments, the barrier replacement mat includes a plurality of tubes surrounded by the plurality of intertwined material. The support rods are inserted into the tubes, and the tubes are removed once the barrier replacement mat is positioned within the frame.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
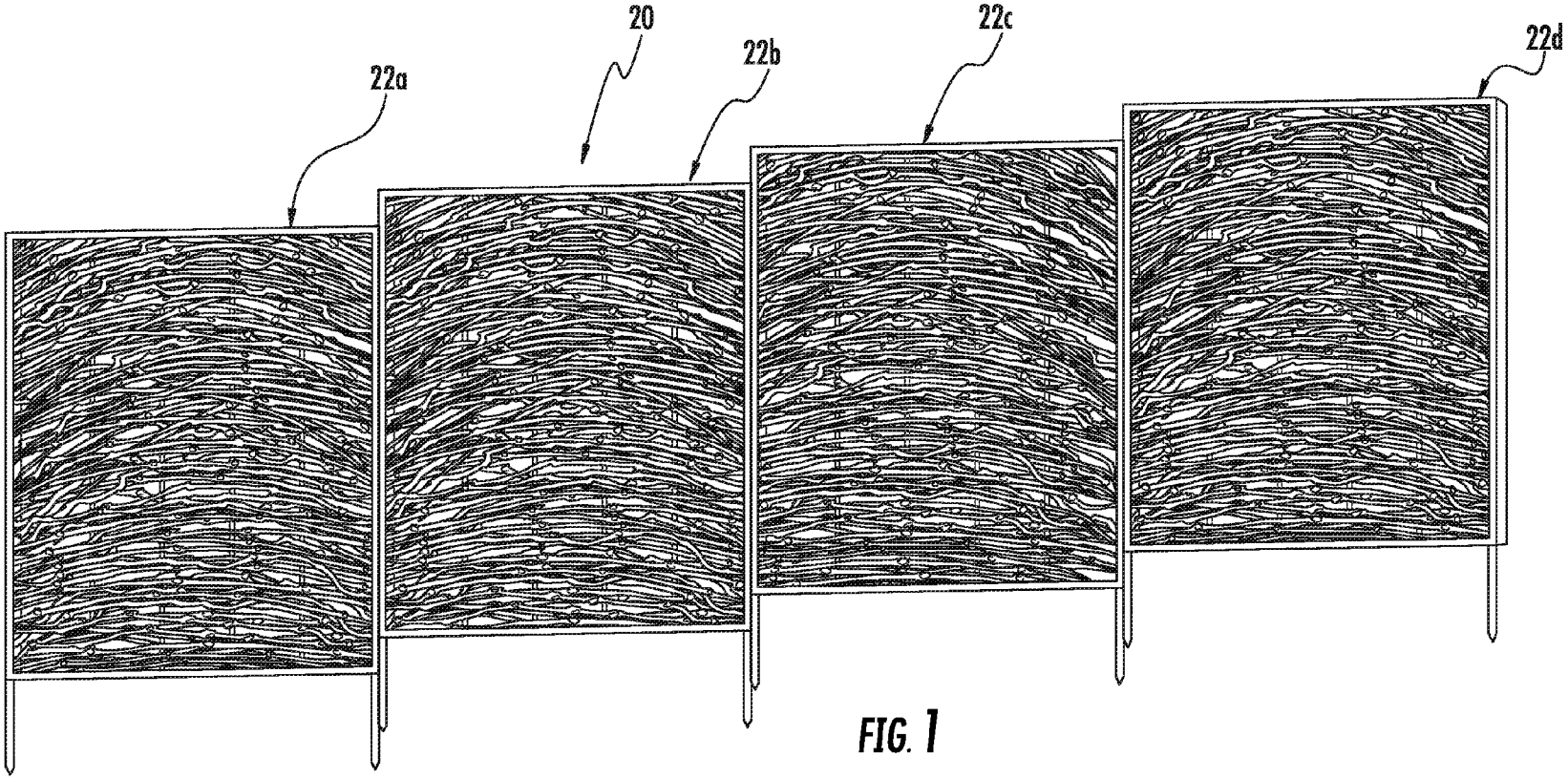
FIG. 1 is a perspective view of a front side of an exemplary fence that includes a plurality of fence panels.

The present disclosure relates to a fence apparatus adapted to form a functional hairier, such as to prevent intrusions, provide privacy, or to provide a wall, such as for growing vines. The fence apparatus may also provide a decorative wall or panel. In an embodiment shown in FIG. 1, the fence apparatus 20 includes a plurality of panel frames 22*a-d*, which stands erect from the ground and form a wall 24. Each of the panel frames 22*a-d* may be of different dimensions. For instance, panel frames 22*a-c* may have varying heights from the ground such that they appear to ascend from panel frame 22*a* to panel frame 22*c* like a staircase. Some of the panel frames may also have equal dimensions, such as panel frames 22*c* and 22*d*. The number of panel frames that have varying heights or equal dimensions may vary depending on the level of the ground and the desired appearance.

Figure 2:
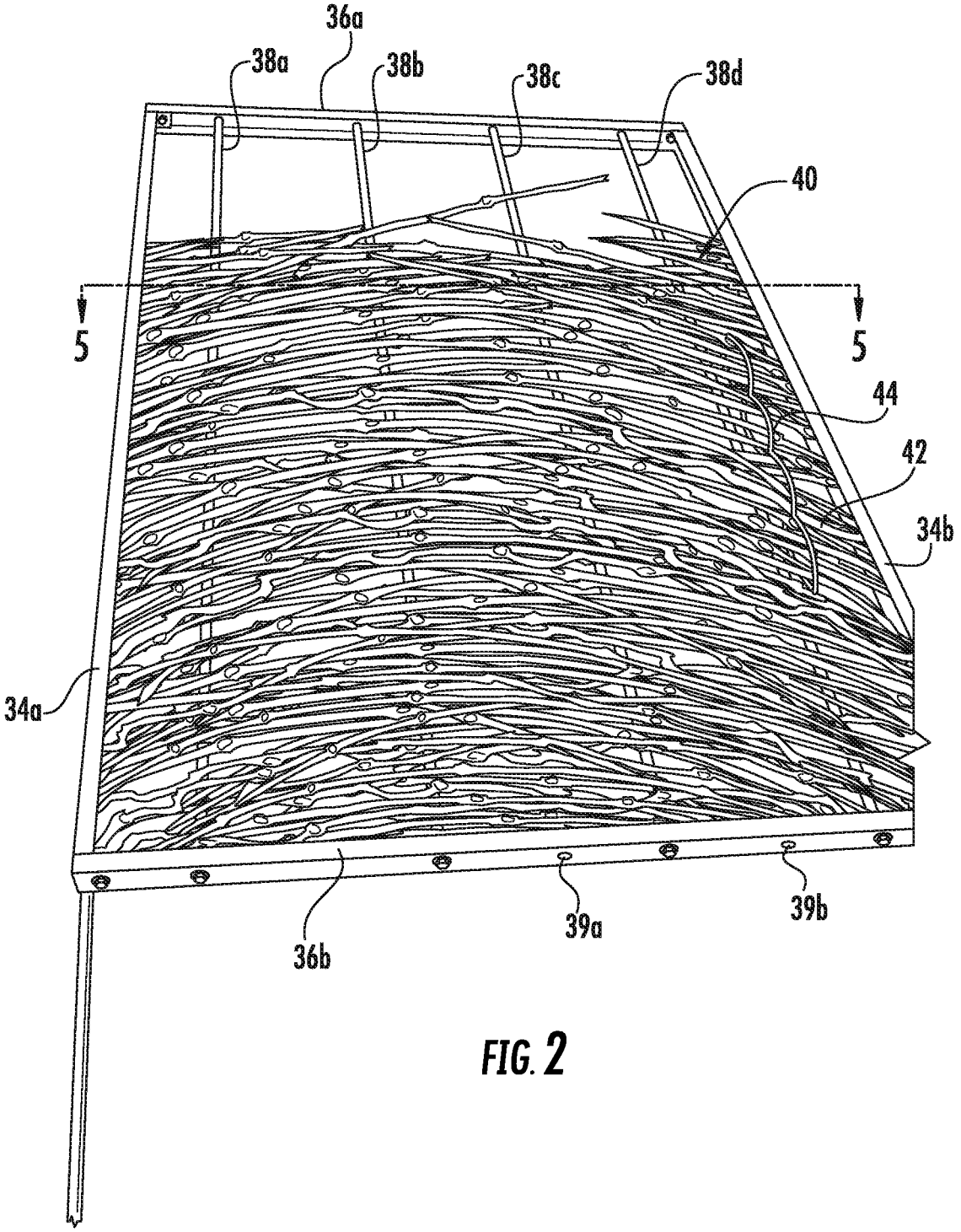
FIG. 2 is an elevation view or an exemplary fence panel.

Referring to FIG. 2, each panel frame 22*a-d* includes a plurality of frame members, such as vertically disposed and opposing, frame members 34*a* and 34*b* and horizontally disposed and opposing frame members 36*a* and 36*b*. Vertically disposed and opposing frame members 34*a* and 3411 are sometimes be referred to as the upright frame members 34*a* and 34*b*, respectively. Horizontally disposed and opposing frame members 36*a* and 36*b* are sometimes be referred to as the longitudinal frame members 36*a* and 36*b*, respectively.

Frame members 34*a*, 34*b*, 36*a* and 36*b* may be arranged to form a rectangular frame and are secured to each other by fasteners. For instance, the upright frame members 34*a* and 34*b* include threaded opposing ends (not shown) to where the longitudinal frame members 36*a* and 36*b* are fastened. The longitudinal frame members 36*a* and 36*b* include corresponding recesses for receiving the threaded ends, which are then secured with fastening nuts (not shown). The fastening nuts may optionally be covered with a hemisphere cap (not shown). This disclosure is not limited to a certain number of frame members or to a certain shape. In the embodiment shown, frame member 36*b* defines a plurality of drainage holes 39*a* and 39*b* adapted to allow water to be drained off the frame. When water is introduced to the fence apparatus, either through rain, gardening, or sprinklers, water weakens the integrity of the frames and negatively affects the looks of the fence. The fence may rust, or the vineyard canes that form the wall of the fence, as further described below, may deteriorate. The availability of the drainage holes is a feature that provides longevity to the fence apparatus both in terms of durability and appearance.

A plurality of support rods 38*a-d* is positioned in between the vertically disposed and opposing frame members 34*a* and 34*b*. The support rods 38*a-d* are vertically oriented relative to the frame members 34*a* and 34*b*, and some of them are equally spaced next to each other, The ends of the plurality of the support rods 38*a-d* are fastened by fasteners to the horizontally disposed and opposing flame members 36*a* and 36*b*. A plurality of plant materials 40 derived from natural plants are weaved around the support rods 38*a-d*. The plant materials 40 are preferably in a form of vineyard canes, including Cabernet, Grenache, and other vigorous vines. Vineyard canes may sometimes be known as grape canes. The vineyard canes 810 preferably processed. For instance, they may be cut at a uniform length; their spurs, buds, or other projecting pieces may be trimmed or cut; they may be treated with waterproofing materials or preservatives; or, they may be stained, varnished or painted with a desired paint color. The wood stains and preservatives may include ammonia, copper, or Alkaline Copper Quaternary types A, B, C, or D (commonly known as ACQ), and their combinations.

The term "weaved" may interchangeably be used with the terms "interlaced," "intertwined," or "twisted" to refer to a configuration wherein a strand of vineyard cane contacts varying sides of the support. rods 38*a-d*. For the sake of clarity, the support rods 38*a-d* include a front side and a back side. Strand 40 contacts the front side of support rod 38*d* then the back side of support rod 38*c* then the front side of support rod 386 and then the hack side of support rod 38*a*. Strand 42 contacts the back side of support rod 38*d* then the front side of support rod 38*c* then the back side of support rod 38*b* and then the back side of support rod 38*a*. This disclosure is not limited to a certain weaving pattern of any of the plant materials. The weaving of the plant materials around the support rods 38*a-d* aids in holding them place within the frame.

Figure 3:
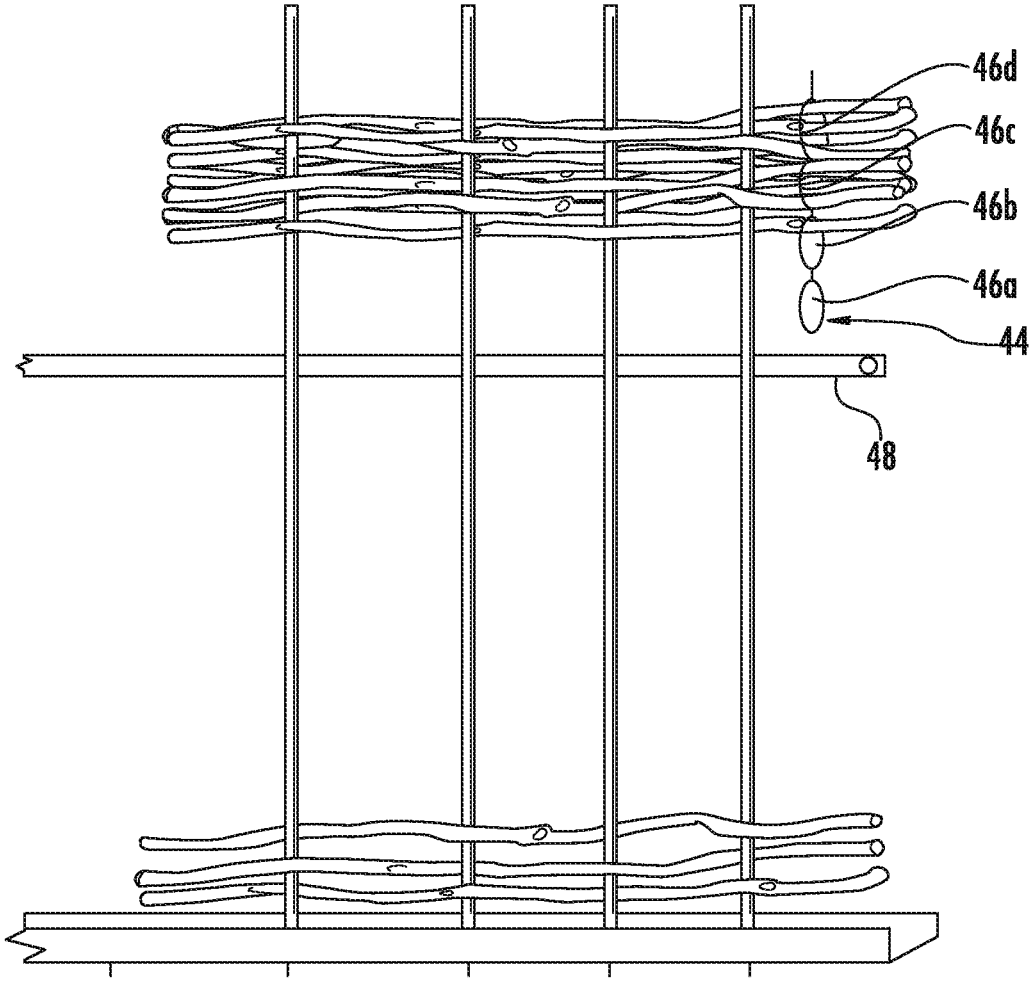
FIG. 3 is a schematic view showing the components of yet another exemplary fence panel.

Referring to FIG. 3, the fence apparatus may include a plant material clamp 44 adapted to hold one end of a plurality of plant materials. The plant material clamp 44 may be a wire, string, plastic ties, or other clamps known in the art. In the example shown, the plant material clamp 44 is in a form of an intertwined wire that includes a plurality of loops 46*a-d*. Each loop 6*a-d* is configured to hold a group of plant material at a desired position, such as in the middle or their ends. As time goes by, the plant materials may deteriorate, become brittle, and easily separate from each other, destroying the barrier or creating holes to the barrier. The plant material clamp 44 prevents this from occurring and provides additional support and durability to the plant materials. Several plant material clamps 44 may be used to hold several groups of plant materials of varying quantity to create a desired shape or pattern. The plant material clamps 44 may be attached to one air more support rods, as desired.

Figure 4:
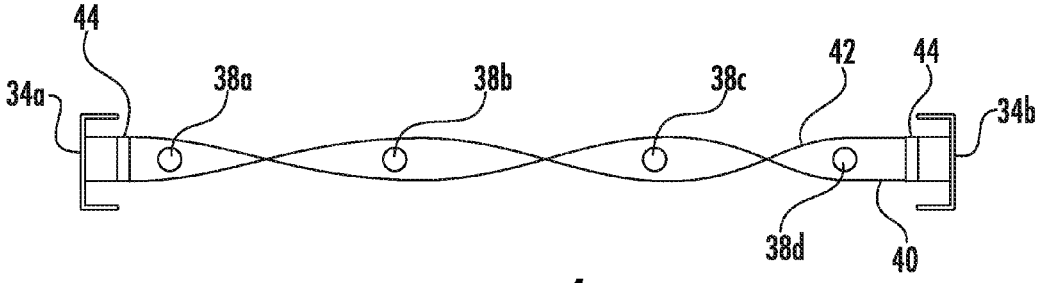
FIG. 4 is a cross-sectional view taken from line 5 of FIG. 2.

The fence apparatus shown in FIG. 3 also includes a reinforcement rail 48 adapted to be positioned in between vertically disposed and opposing frame members 34*a* and 34*b* (not shown in FIG. 4). The reinforcement rail 48 is made of durable materials, such as metal, and is adapted to prevent each of the frame members 34*a* and 34*b* from deforming. The deformation of the frame members 34*a* and 34*b* is minimized by the reinforcement rail 48 to prevent the fence from being destroyed and to save the fence from becoming unappealing. The support rods 38*a-d*preferably pass through and cross the reinforcement rail 48. Some support rods are inserted into the reinforcement rail 48 and some are not inserted and just cross the reinforcement rail to produce as crisscross orientation. This crisscross orientation further adds strength to each panel.

Figure 5:
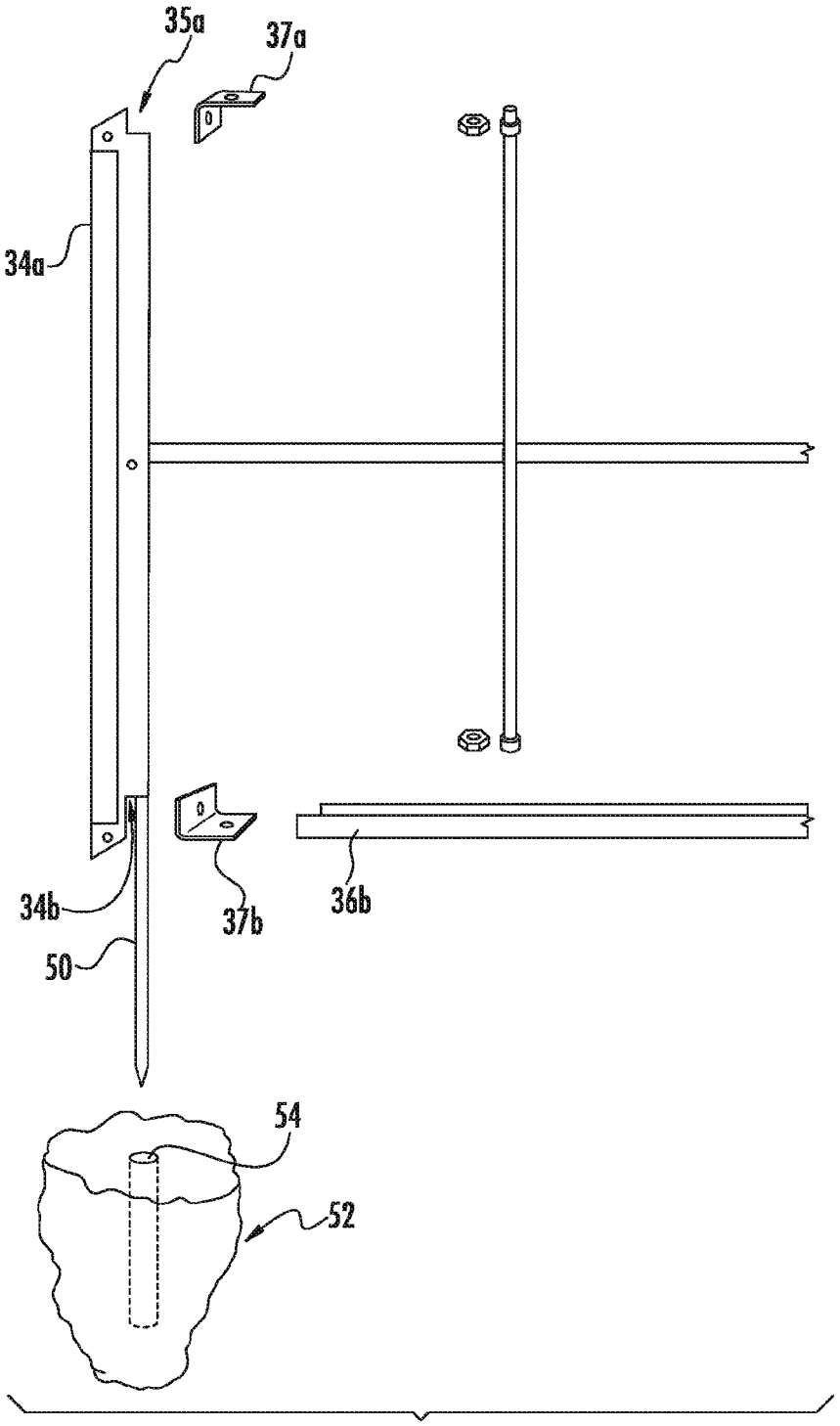
FIG. 5 is an exploded view of showing the attachment components of the frame members.

Referring to FIG. 4, the frame members 34*a* and 34*b* firm a C-shaped channel to contain within its channel the plant material strands 40 and 42 that are held by the plant material clamp 44. Plant material strands 40 and 42 are preferably weaved around support rods 38*a-d* in a desired weaving pattern, which can vary from the weaving pattern shown in FIG. 5. Referring to FIG. 5, the frame members 34*a* and 34*b* include a pair of frame mounting ends 35*a* and 35*b* and corresponding frame mounting brackets 37*a* and 37*b*. In certain embodiments, frame mounting, ends 35*a* and 35*b* are cut to accommodate the horizontal frame members 36*a* and 36*b* in a manner wherein the horizontal frame member 36*a* can be continuously attached to and can form a right angle with vertical frame member 34*a*, and the horizontal frame member 36*b* can also continuously be attached to and can form a right angle with vertical frame member 34*a*. Frame mounting brackets 37*a* and 37*b* may each be an L-shaped bracket. A portion of each of the frame mounting bracket 37*a* or 37*b* is attached to its respective horizontal frame member and another portion is attached to its respective vertical frame member. In embodiments where multiple panels are used to build as fence and the multiple panels have varying heights, such as the ascending panels shown in FIG. 1, the L-shaped bracket is used to attach the panels to each other. A horizontal portion of the L-shaped bracket is attached to a horizontal frame member of a first panel, and a vertical portion of the L-shaped bracket is attached to a vertical frame member of a second panel. In embodiments where the multiple panels are of the same height, a one-piece flat mount may be used. A portion of the flat mount is attached to a horizontal frame member of a first panel, and an opposing portion of the flat mount is attached to a horizontal frame member of a second panel.

Each panel 22*a-d* is preferably made to stand on the ground using a combination of a pole 50 and an in-ground stake mount 52. The pole 50 is attached by fasteners or by welding it to the vertical frame members 34*a* and 34*b* (either on the side or on the portion of the frame member that is nit the same plane as the rear side of the barrier). The pole preferably descends up to 36 inches below the bottom of the frame member and can be cut to a desired length. The in-ground stake mount 52 is preferably in a form of a recess formed on a ground and as sleeve 54 positioned within the recess. The in-ground stake mount 52 may be created by digging a hole on the ground, pouring concrete, and positioning a sleeve in the hole before the concrete dries. The pole 50 is configured to be inserted into the sleeve, which consequently would hold the panel in an upright position.

Figure 6:
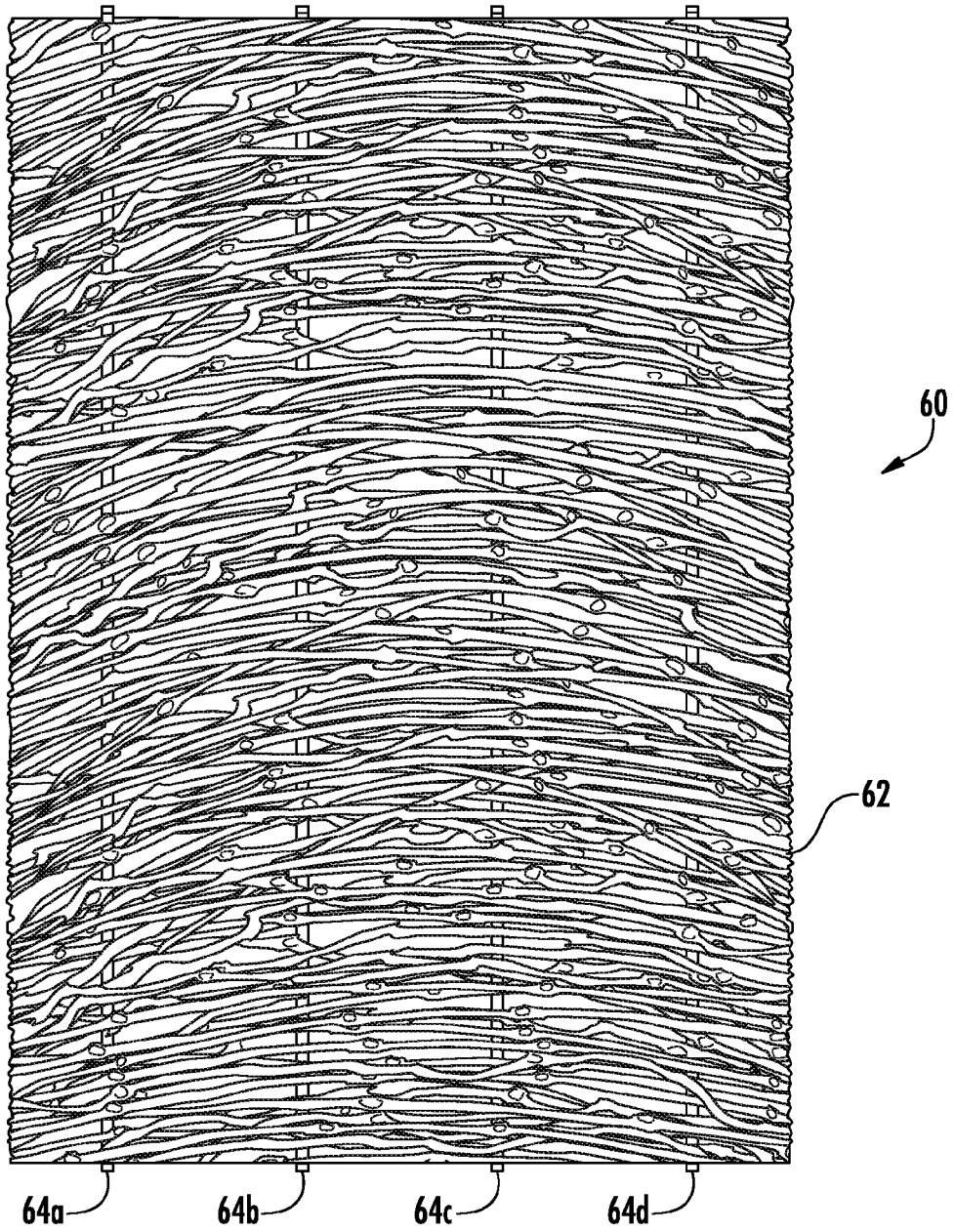
FIG. 6 is a front view of a replacement barrier mat of the present disclosure.

FIGS. 6-11 show the feature of being able to quickly and easily replace the plant material 40 with a replacement barrier mat 60. In certain embodiments, the replacement barrier mat 60 is also made of vineyard canes previously described. The plain material 40 can easily be replaced without having to replace the frame. This feature is beneficial when the plant materials 40 degrade overtime, or when plant materials of different color or appearance is desired. FIG. 6 shows a replacement barrier mat 60 having intertwined vineyard canes 62 that will replace the plant material 40 and will serve as a wall. The intertwined vineyard canes 62 are woven around a plurality of removable support rod receivers 64*a-d*. In certain embodiments, the support rod receivers 64*a-d* are in the form of robes. The tubes are preferably made of PVC pipes. The support rod receivers 64*a-d*alum with their respective support rods 38*a-d* when the replacement barrier mat 60 is positioned within the frame, the support rods 38*a-d* insert into their respective support rod receivers 64*a-d*, Once the support rods 38*a-d* are fully inserted into their respective support rod receivers 64*a-e*, the replacement barrier mat 60 is properly positioned within the frame. The support rod receivers 64*a-d* can then be removed.

Figure 7:
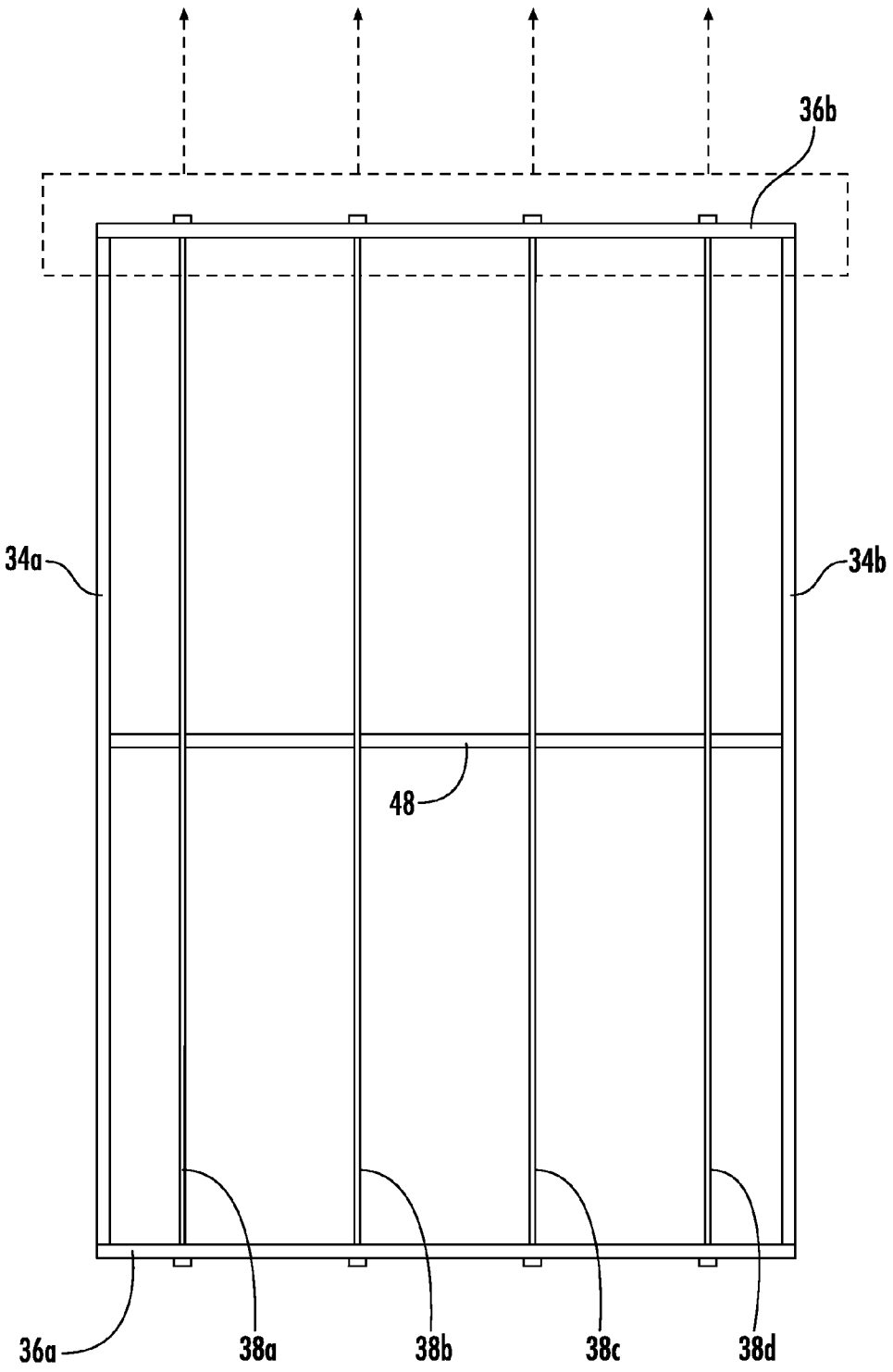
FIG. 7 is a front view of the fence apparatus with the plant material removed and ready to be replaced with the replacement barrier mat of FIG. 6.
Figure 8:
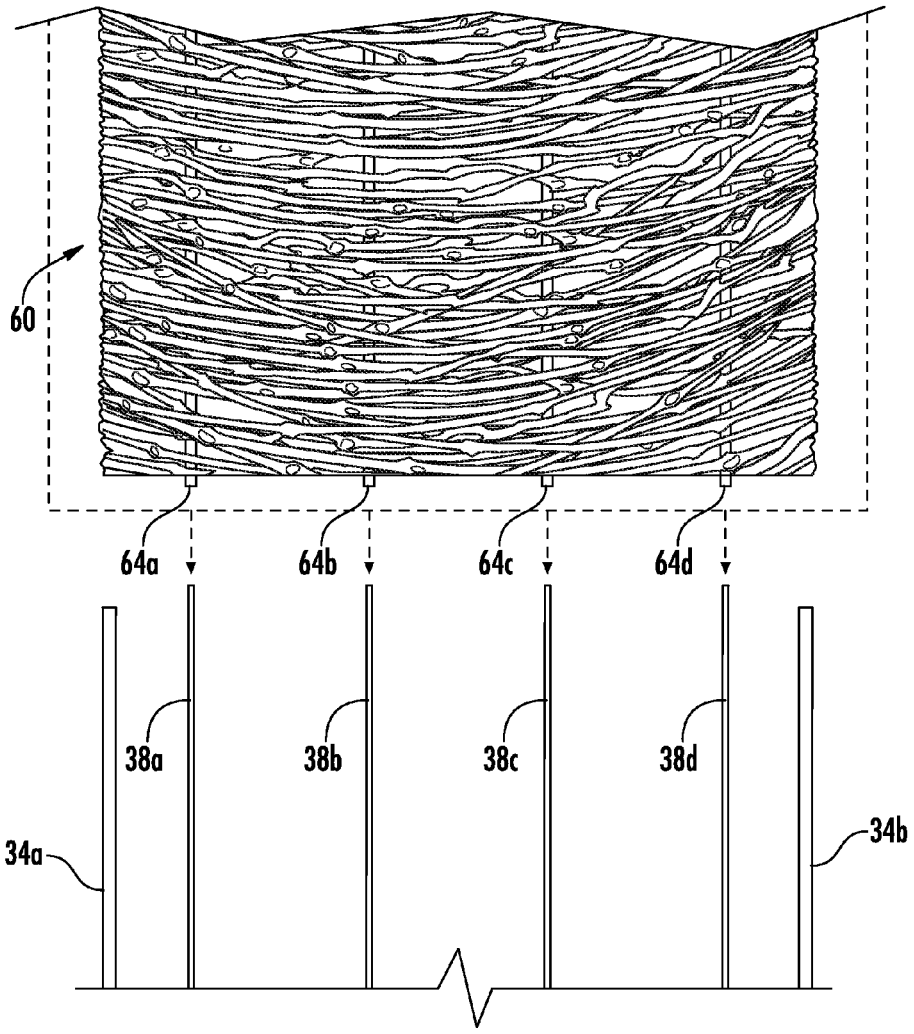
FIG. 8 is a schematic view of the replacement barrier mat of FIG. 6 being inserted into the frame of the fence apparatus.

Referring to FIG. 7, to replace the plant material 40 with the replacement barrier mat 60, the top longitudinal frame member 36*a* is first removed, as shown by the broken lines, by loosening its fasteners from the vertical frame members 34*a* and 34*b*. The plant material 40 is removed from the frame. The reinforcement rail 48 is removed next to allow the support rod receivers 64*a-d* of the replacement barrier mat 60 to slide through their respective support rods 38*a-d*. FIG. 8 shows the removable support rod receivers 64*a-d* of the replacement barrier mat 60 being aligned with their respective support rods 38*a-d* so that the support rods 38*a-d* can be inserted into their respective support rod receivers 64*a-d* in the direction shown by the broken lines and arrows. The support rods 38*a-d* guide the placement of the replacement barrier mat 60 within the frame. The replacement battier mat 60 slides all the way to the bottom of the frame and positions within the frame to serve as a wall.

Figure 9:
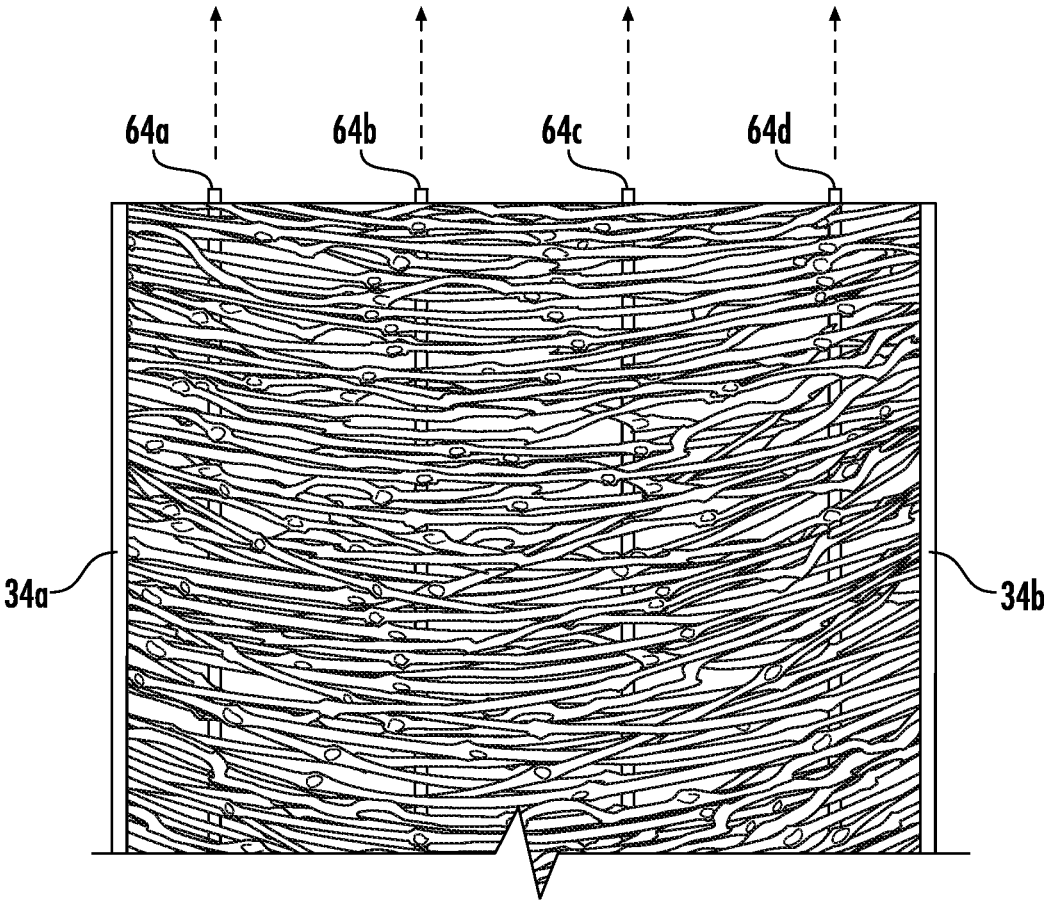
FIG. 9 is a front view of the fence apparatus with plant material replaced with the replacement barrier mat and showing the tubes of the replacement barrier mat to be removed in the direction of the arrows.
Figure 10:
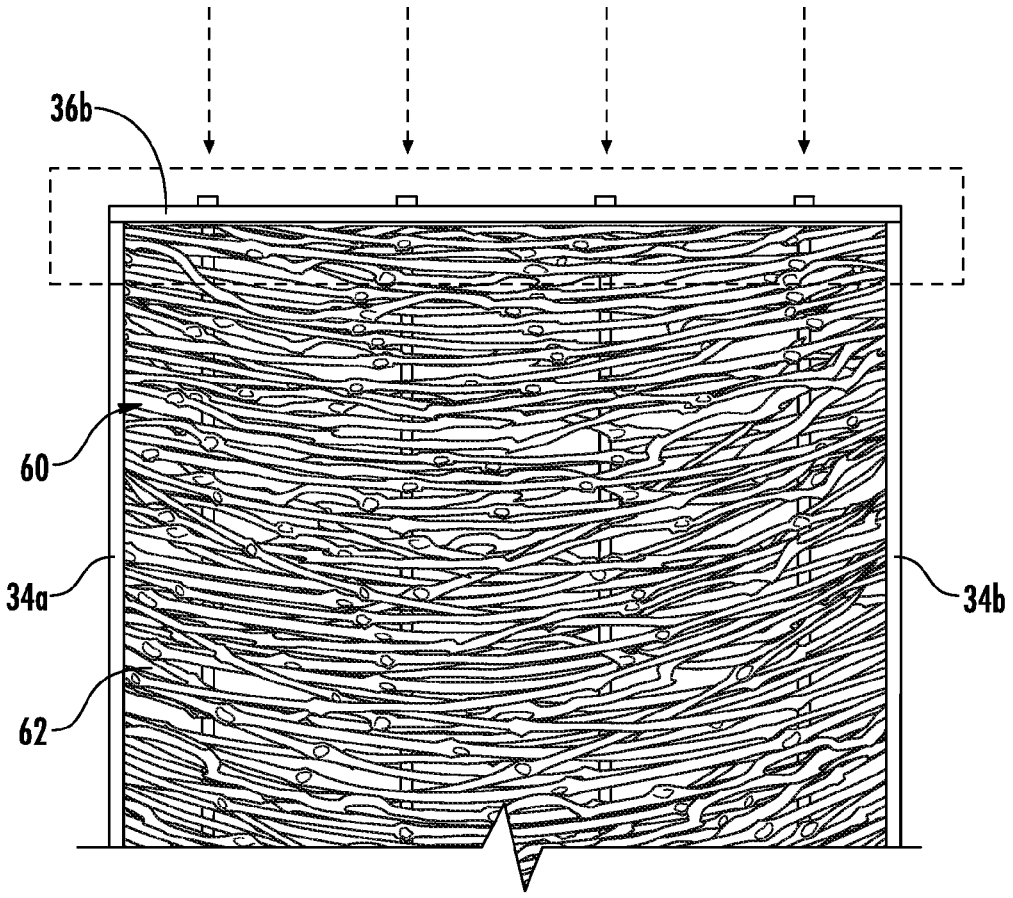
FIG. 10 is a front view of the fence apparatus of FIG. 9 with plant material having been replaced and showing the top horizontal frame member being reattached.
Figure 11:
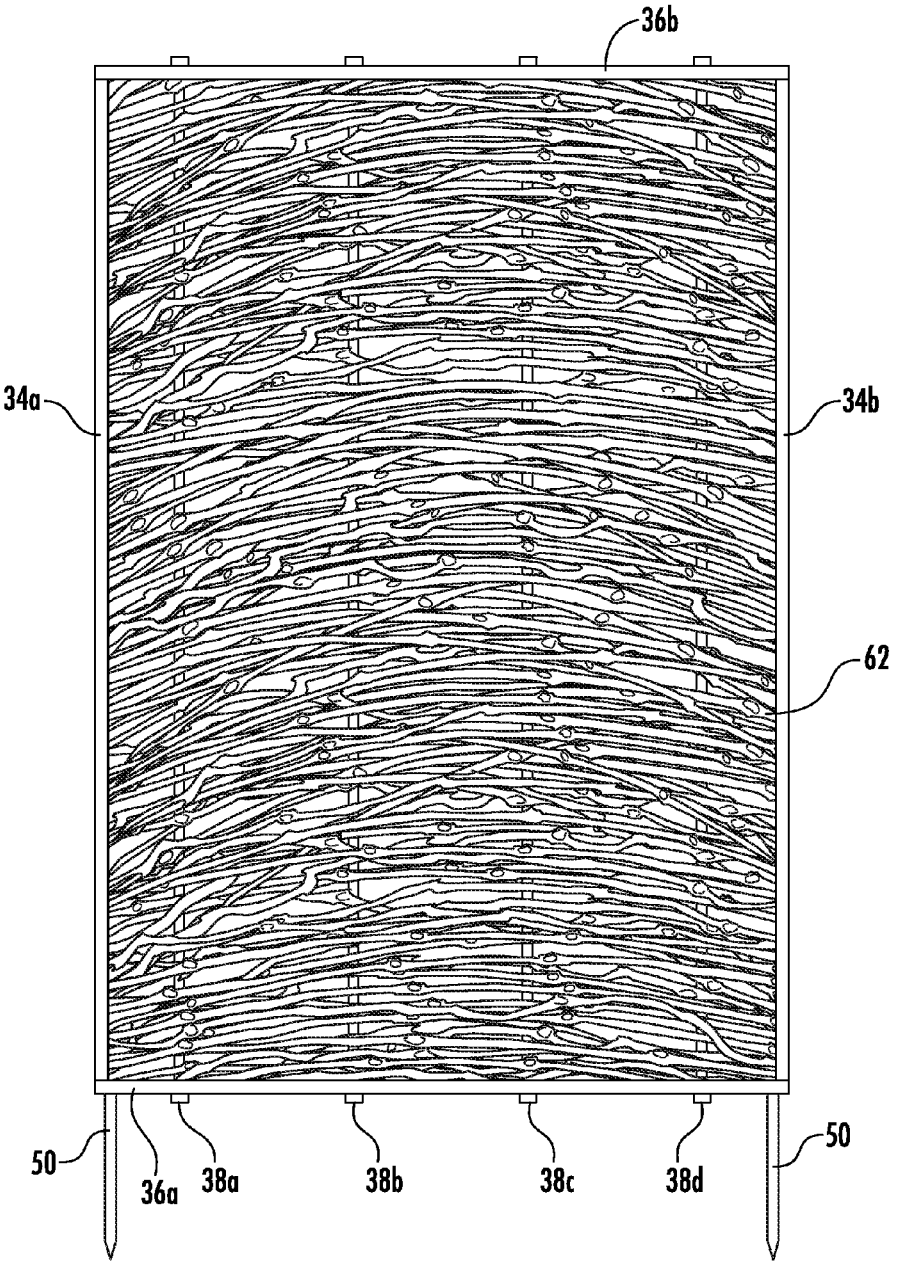
FIG. 11 is a front view of the fence apparatus fully installed with the plant material having been replaced with the replacement barrier mat.

Once the replacement barrier mat 60 is properly positioned within the frame, the support rod receivers 64*a-d* are removed from the intertwined vineyard canes and their respective support rods 38*a-d*, by pulling them in the direction shown by the broken arrows (FIG. 9). The support rods 38*a-d* hold the intertwined vineyard canes 62 of the replacement barrier mat 60 within the frame. The reinforcement rail 48 is re-attached to the upright frame members 34*a*, 34*b*. The top longitudinal frame member 36*a* is re-attached to the upright frame members 14*a*, 34*b* (FIG. 10) as shown by the broken lines and arrows FIG. 11 shows a fully assembled fence apparatus with the plant material having been replaced with the replacement barrier mat 60.

It can be realized that certain embodiments provide fence apparatus that use the combination of durable materials, such as steel, with indigenous materials to withstand the test of time and natural elements, such as wind, rain, and sun. Certain embodiments provide fence apparatus that are made of replaceable parts so that when the replaceable parts show some signs of wear, they can be replaced for maintenance, or when the replaceable parts break, they can be replaced, which avoids haying to discard the entire fence apparatus. The durable materials typically have a much longer lifespan than the indigenous materials. The present disclosure allows for the indigenous materials to be easily replaced to match the longevity of the durable materials. The present disclosure also provides indigenous materials that are fast growing, regenerative, and available all year long. The indigenous materials can be grouped independently and then slid over and tucked in the frame members of an empty frame to swap in a new woven barrier.

While the exemplary embodiments are described above, it is not intended that these embodiments describe all possible &inns of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of replacing a wall of a fence having a plurality of frame members adapted to form a frame and a plurality of support rods positioned in between the frame members, the method comprising:

providing a barrier replacement mat including a plurality of intertwined material adapted to provide a wall, the barrier replacement mat further including a plurality of tubes surrounded by the plurality of intertwined material;

inserting the support rods into to the plurality of tubes and the plurality of intertwined material of the barrier replacement mat to position the plurality of intertwined material within the frame; and removing the tubes once the barrier replacement mat is positioned within the frame.

2. The method of claim 1 wherein the plurality of intertwined material of the replacement barrier mat comprises a plurality of intertwined vineyard canes.

* * * * *